US005626787A

United States Patent [19]

Porter

[11] Patent Number: 5,626,787

[45] Date of Patent: May 6, 1997

[54] FIRE EXTINGUISHING COMPOSITION

[76] Inventor: Ronald A. Porter, 52 Main St., Delaware, Ontario, Canada, N0L 1E0

[21] Appl. No.: 497,688

[22] Filed: Jun. 30, 1995

[30] Foreign Application Priority Data

Jul. 4, 1994 [CA] Canada ..... 2127341

[51] Int. Cl.[6] ..... A62D 1/06

[52] U.S. Cl. ..... 252/4; 252/2; 252/5; 252/7; 169/45; 169/46

[58] Field of Search ..... 252/2, 4, 5, 7; 169/45, 46, 47

[56] References Cited

U.S. PATENT DOCUMENTS

| | | | |
|---|---|---|---|
| 2,768,952 | 10/1956 | Anthony, Jr. et al. | 252/7 |
| 2,937,990 | 5/1960 | Warnock | 252/2 |
| 3,017,348 | 1/1962 | Steppe et al. | 252/2 |
| 3,172,852 | 3/1965 | Lobos | 252/5 |
| 3,673,088 | 6/1972 | Clements | 252/2 |
| 4,134,242 | 1/1979 | Musz et al. | 52/309.1 |
| 4,313,997 | 2/1982 | Ruff et al. | 428/220 |
| 4,552,803 | 11/1985 | Pearson | 428/262 |
| 4,968,441 | 11/1990 | Halter et al. | 252/2 |
| 5,076,969 | 12/1991 | Fox | 252/601 |
| 5,284,700 | 2/1994 | Strauss et al. | 428/240 |

OTHER PUBLICATIONS

Chemical Abstracts Service, Abstract No. 111:62908, Farmazyan et al., "Composition For Manufacturing thermal–insulating articles", Sourced From: U.S.S.R. Otkrytiya, Izobret. 1989, (13), 105, which was sourced From: Patent No. SU 1470706 A1, (Issued Apr. 7, 1989).

Chemical Abstracts Service, Abstract No. 113:210812, by Glaser et al., "Processing of Phosphorus–Containing Solid Residues", Sourced From: Czech Patent No. CS 260481 B1, (Issued Apr. 15, 1989).

Chemical Abstracts Service, Abstract No. 87:186709, by Baratov et al., "Fire extinguishing agent For extinguishing combustible Fluids", Sourced From: U.S.S.R. Otkrytiya, Izobret., 1977, 54(29), pp. 226–227, which was sourced From: Patent No. SU 423323, (issued Aug. 5, 1977).

Chemical Abstracts Service, Abstract No. 99:217389, by Petkov., "Study of the Production of perlite heat–insulating gunite materials with ammonium phosphate based binding materials", Sourced From: Stroit. Mater. Silik. Prom–ST, (Dec. 1983), 24(3), pp. 17–20.

*Primary Examiner*—Sharon Gibson
*Assistant Examiner*—Joseph D. Anthony
*Attorney, Agent, or Firm*—Pearne, Gordon, McCoy & Granger

[57] ABSTRACT

A fire extinguishing composition is disclosed consisting essentially of a mixture of (i) desiccated expanded perlite (aluminum silicate) and (ii) mono- and di-ammonium phosphates. The phosphate fraction of the composition preferably includes urea, ammonium chloride, glycerine and mono-ethylene glycol.

13 Claims, No Drawings

FIRE EXTINGUISHING COMPOSITION

BACKGROUND OF THE INVENTION

The present invention relates to the field of fire fighting. In particular, the present invention provides a range of novel and effective fire extinguishing compositions. The compositions of the present invention are useful in extinguishing alkali metal and other metal fires, and fires involving gasoline and other organic fuels and solvents.

DESCRIPTION OF RELATED ART

In the field of fire fighting, metal fires, particularly alkali metal fires, are considered to be especially hazardous, and difficult to extinguish. They burn at very high temperatures, and often react explosively when doused with water. Moreover, halons are not compatible with metal fires.

To combat metal fires, such as fires involving Mg, Al, U, Na, K, Zi, Zr, Ca or Ti, each of which is considered a fire hazard, a number of dry extinguishing agents have been developed, and are accepted by the fire fighting community. These include Pyrene™ and Metalguard™ which are graphitized coke mixed with organic phosphate for use with Mg, Al, U, Na and K fires; Met-L-X™, being $NaCl+Ca_3(PO_4)_2$ for use against Na fires; Lith-X™, a graphite based agent for use against Li, Mg, Zr and Na fires; Pyromet™, $(NH_4)_2H(PO_4)+NaCl$, for use against Na, Ca, Zr, Ti, Mg and Al fires, T.E C.™, being $KCl+NaCl+BaCl_2$ for use against Mg, Na and K fires. In addition, foundry flux, dry sand, soda ash, LiCl, and $ZrSiO_4$ are also accepted dry agents. Liquid and gaseous agents are also known, but are of limited utility against metal fires. In the case of the liquid agent Trimethoxyboroxine, that is used against Mg, Zr and Ti fires, it will be understood that an imperative in fighting a metal fire is physical containment of the burning chips, powder or turnings. A liquid agent will tend to work against this goal. Gaseous agents such as $FB_3$, $BCl_3$, He, Ar and $N_2$ may be effective in a contained area, but may tend to scatter the burning metal, which is usually in particulate or coarsely divided form. If this happens, the fire may spread, rather than go out.

In general, the performance of extinguishing agents for use against metal fires has not been considered satisfactory. A need has existed for an extinguishing agent which will quickly and efficiently extinguish a metal fire, without any toxic side effects.

In the case of fires involving gasoline or other organic solvents or fuels, water is inappropriate as an extinguishing agent and so the great majority of agents are foams. Solids such as powders are generally inappropriate for use against fires involving liquids since they tend to sink through the liquid, or not cover its surface sufficiently. A concern with foams or other liquid based extinguishing agents is that the resultant liquid plus extinguishing agent combination may be a potent pollutant, and the containment vessel for the liquid may have been destroyed in the fire, or the fire may have been the result of a spill. In such instances, the extinguishing agent may in fact increase the overall volume of pollutant, or permit the pollutant to flow into a sensitive area.

Objects of the present invention, in view of the foregoing, include:

i) to provide a dry solid extinguishing agent to quickly and efficiently extinguish metal based fires;

ii) to provide an extinguishing agent that is safe and non-polluting; and iii) to provide a dry solid extinguishing agent that quickly extinguishes organic fuel or solvent fires, and in addition tends to absorb liquid, thereby to minimize the possibility of re-ignition or the potential for pollution.

SUMMARY OF THE INVENTION

In a broad aspect, the present invention relates to a fire extinguishing composition, consisting essentially of a mixture of (i) desiccated expanded perlite (aluminum silicate) and (ii) mono- and di-ammonium phosphates.

Preferably, there is provided from about 99% by weight to about 50% by weight of said (i) perlite.

Moreover, preferably said phosphate fraction of said composition includes urea and ammonium chloride.

Said phosphate fraction may also further include ammonium chloride, glycerine and mono-ethylene glycol.

In an embodiment effective against gasoline or other hydrocarbon fuel fires, said composition includes from about 98% to about 96% of said perlite fraction.

In an embodiment effective against metal fires, said composition includes from about 85% to 60% of said perlite fraction, preferably from about 82% to 65% of said perlite fraction.

In one embodiment that has proven effective against magnesium fires, said composition includes about 80% of said perlite fraction.

In another embodiment that has proven effective against magnesium fires, said composition includes about 67% of said perlite fraction.

The phosphate fraction of the composition has preferably got the following fractional composition:

a) about 19%–20% urea b) about 2%–3% ammonium chloride c) about 41%–42% mono-ammonium phosphate d) about 32%–33% di-ammonium phosphate e) about 1.5%–2.5% glycerine f) about 1.5%–2.5% mono-ethylene glycol

DETAILED DESCRIPTION OF THE PREFERRED EMBODIMENTS OF THE INVENTION

The present invention uses, as its base, ground expanded perlite. Perlite is a naturally occurring form of amorphous alumina silicate. In its natural form, perlite has a specific gravity of 2.28. In expanded or "popped" form, the specific gravity falls to the range of 0.08–0.20, as water is driven from the perlite, and air space increased. A source of an appropriate expanded perlite under the trade mark COMBI-ZORB is Global Eco Systems of Costa Mesa, Calif. The expanded perlite, for use in the compositions of the present invention is ground to a finely divided and flowable consistency. Precise particle size is not important.

The ground expanded perlite is combined in an amount, based on weight percentages of about 99% to about 50% with a mixture of mono and di-ammonium phosphates sold by Precom International under the trade mark "BURN-STOP".

A preferred formulation of BURNSTOP is as follows:

Urea 19.21% (wt)

Ammonium chloride 2.68%

Mono-ammonium phosphate 41.26%

Di-ammonium phosphate 32.86%

Glycerine 2.00%

Mono-ethylene glycol 1.99%

It will be understood that the foregoing percentages and formulation are not meant to be limiting, but are presented as exemplary of a preferred formulation. Other formulations of mono- and di-ammonium phosphates will be a matter of choice to one skilled in the art. The foregoing product will be referred to as the "phosphate composition".

The ground perlite and phosphate composition combination are blended together to form a dry powder of consistent composition.

The preferred formulation for combating organic solvent or fuel fires is about 1%–5% preferably 2% phosphate composition, and about 95%–99% ground expanded perlite. The combination, when applied to a fire will extinguish it quickly, and the perlite will act as an absorbent to collect many times its own weight in flammable liquid.

The preferred formulation for combating metal fires is about 10%–40%, preferably 20%–30% phosphate composition, and about 70%–90% ground expanded perlite. Rock salt, NaCl may be added to the combination, to provide mass. The combination, when applied onto a well involved metal fire, such as a fire in magnesium turnings or chips, should be patted down over the entire area of combustion, and the fire will then quickly be extinguished.

In order to demonstrate the efficacy of the product of the present invention, a number of comparative tests were performed. In each, the phosphate composition utilized was the BURNSTOP™ product, the details of which are summarized above. The ground expanded perlite product was COMBIZORB™, as described above. The test results were as summarized in the table below.

| Test No. | Combustible Test Material | % Perlite | % Phosphate Composition | Remarks |
|---|---|---|---|---|
| 1 | Mg chips | 0% | 100% | Fire enhanced. Test a failure. |
| 2 | Mg chips | 100% | 0% | Fire contained but not extinguished. |
| 3 | Mg chips | 95% | 5% | Fire flared. Test a failure. |
| 4 | Mg chips | 80% | 20% | Flame lost immediately, fire extinguished quickly. |
| 5 | Mg chips | 67% | 33% | Fire extinguished quickly. |
| 6 | Li chips | 80% | 20% | Fire extinguished quickly. |
| 7 | Gasoline | 98% | 2% | Fire extinguished quickly, excess gasoline absorbed would not re-light. |

It will be observed, then, that the present invention provides a composition that quickly and efficiently extinguishes fires in both metals and organic fuels and solvents.

It is to be understood that the examples described above are not meant to limit the scope of the present invention. It is expected that numerous variants will be obvious to the person skilled in the field of fire extinguishing composition formulation without any departure from the spirit of the invention. The appended claims, properly construed, form the only limitation upon the scope of the invention.

I claim:

1. A fire extinguishing composition, consisting essentially of a mixture of (i) desiccated expanded perlite having a specific gravity of 0.08–0.20 and (ii) a mono- and di-ammonium phosphate composition fraction, said fire extinguishing composition including from about 99% to about. 50% by weight of said perlite, said phosphate fraction including urea, ammonium chloride, glycerine, and mono-ethylene glycol.

2. A fire fighting composition as claimed in claim 1, wherein said composition includes from about 98% to about 96% by weight of said perlite.

3. A fire fighting composition as claimed in claim 1, wherein said composition includes from about 95% to 50% by weight of said perlite.

4. A fire fighting composition as claimed in claim 1, wherein said composition includes from about 85% to 60% by weight of said perlite.

5. A fire fighting composition as claimed in claim 2, wherein said composition includes from about 82% to 65% by weight of said perlite.

6. A fire fighting composition as claimed in claim 1, wherein said composition includes about 80% by weight of said perlite.

7. A fire fighting composition as claimed in claim 1, wherein said composition includes about 67% by weight of said perlite.

8. A method of combatting fires, by applying thereto a fire extinguishing effective quantity of a fire extinguishing composition as claimed in claim 1.

9. A fire extinguishing composition as claimed in claim 1, wherein said phosphate fraction of said composition has the following fractional composition by weight:

a) about 19%–20% urea b) about 2%–3% ammonium chloride c) about 41%–42% mono-ammonium phosphate d) about 32%–33% di-ammonium phosphate e) about 1.5%–2.5% glycerine f) about 1.5%–2.5% mono-ethylene glycol.

10. A fire extinguishing composition as claimed in claim 3, wherein said composition includes from about 99% to about 95% by weight of said perlite.

11. A fire fighting composition as claimed in claim 10, wherein said phosphate fraction of said composition has the following fractional composition by weight:

a) about 19%–20% urea b) about 2%–3% ammonium chloride c) about 41%–42% mono-ammonium phosphate d) about 32%–33% di-ammonium phosphate e) about 1.5%–2.5% glycerine f) about 1.5%–2.5% mono-ethylene glycol.

12. A fire extinguishing composition as claimed in claim 1, wherein said fire extinguishing composition consists of desiccated expanded perlite, mono-ammonium phosphate, di-ammonium phosphate, urea, ammonium chloride, glycerine, and mono-ethylene glycol.

13. A fire extinguishing composition as claimed in claim 12, wherein said composition includes from about 99% to about 95% by weight of said perlite.

* * * * *

UNITED STATES PATENT AND TRADEMARK OFFICE

CERTIFICATE OF CORRECTION

PATENT NO. : 5,626,787

DATED : May 6, 1997

INVENTOR(S) : Ronald A. Porter

It is certified that error appears in the above-indentified patent and that said Letters Patent is hereby corrected as shown below:

The corrections are in column 4:

Claim 1, line 6, "about. 50%" should be --about 50%--.

Claim 5, line 1, "2," should be --1,--.

Claim 10, line 2, "3," should be --1,--.

Signed and Sealed this

Fifth Day of August, 1997

Bruce Lehman

*Attest:*

BRUCE LEHMAN

*Attesting Officer*

*Commissioner of Patents and Trademarks*